US009164435B2

(12) United States Patent
Adachi et al.

(10) Patent No.: US 9,164,435 B2
(45) Date of Patent: Oct. 20, 2015

(54) FIXING DEVICE AND IMAGE FORMING APPARATUS

(71) Applicants: Tomoya Adachi, Hyogo (JP); Atsushi Takehara, Kyoto (JP); Tomohiko Fujii, Hyogo (JP); Yutaka Naitoh, Hyogo (JP); Minoru Toyoda, Hyogo (JP); Hitoshi Fujiwara, Osaka (JP); Yasuharu Kawarasaki, Osaka (JP); Naoki Nakatake, Hyogo (JP); Keiji Kunimi, Osaka (JP); Takahiro Sanada, Hyogo (JP); Yasuhide Matsuno, Osaka (JP); Rumi Miyazaki, Osaka (JP); Kyoko Abe, Osaka (JP); Takeshi Yamashita, Osaka (JP); Yasuhiro Fujiwara, Osaka (JP)

(72) Inventors: Tomoya Adachi, Hyogo (JP); Atsushi Takehara, Kyoto (JP); Tomohiko Fujii, Hyogo (JP); Yutaka Naitoh, Hyogo (JP); Minoru Toyoda, Hyogo (JP); Hitoshi Fujiwara, Osaka (JP); Yasuharu Kawarasaki, Osaka (JP); Naoki Nakatake, Hyogo (JP); Keiji Kunimi, Osaka (JP); Takahiro Sanada, Hyogo (JP); Yasuhide Matsuno, Osaka (JP); Rumi Miyazaki, Osaka (JP); Kyoko Abe, Osaka (JP); Takeshi Yamashita, Osaka (JP); Yasuhiro Fujiwara, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/084,127

(22) Filed: Nov. 19, 2013

(65) Prior Publication Data

US 2014/0153982 A1 Jun. 5, 2014

(30) Foreign Application Priority Data

Dec. 5, 2012 (JP) ..... 2012-266292

(51) Int. Cl.
*G03G 15/20* (2006.01)

(52) U.S. Cl.
CPC ..... *G03G 15/2028* (2013.01)

(58) Field of Classification Search
CPC ..... G03G 15/2053; G03G 2215/2035; G03G 15/2064; G03G 15/2085; G03G 15/2017; G03G 15/2089; G03G 15/206; G03G 9/08755; G03G 9/08795; G03G 9/08797; G03G 15/2025; G03G 15/2028; G03G 15/2039
See application file for complete search history.

(56) References Cited

U.S. PATENT DOCUMENTS

| | | | | |
|---|---|---|---|---|
| 6,792,240 | B2 * | 9/2004 | Shida et al. | 399/333 |
| 2008/0056783 | A1 | 3/2008 | Yamamoto et al. | |
| 2009/0060572 | A1 | 3/2009 | Naitoh et al. | |

(Continued)

FOREIGN PATENT DOCUMENTS

| | | |
|---|---|---|
| JP | 9-197864 | 7/1997 |
| JP | 2008-225021 | 9/2008 |
| JP | 2009-222810 | 10/2009 |

OTHER PUBLICATIONS

U.S. Appl. No. 14/024,900, filed Sep. 12, 2013.

(Continued)

*Primary Examiner* — Roy Y Yi
(74) *Attorney, Agent, or Firm* — Harness, Dickey & Pierce

(57) ABSTRACT

A fixing device includes a nip formation pad disposed opposite an inner circumferential surface of an endless belt and a pressing rotary body pressed against the nip formation pad via the endless belt to form a fixing nip between the endless belt and the pressing rotary body, through which a recording medium is conveyed. The pressing rotary body has a diameter increasing from a center to each lateral end in an axial direction thereof. The nip formation pad includes a projection disposed downstream from a rotation axis of the pressing rotary body in a recording medium conveyance direction. The projection projects toward the pressing rotary body in an amount increasing from each lateral end to a center in a longitudinal direction of the nip formation pad parallel to the axial direction of the pressing rotary body.

13 Claims, 4 Drawing Sheets

(56) References Cited

U.S. PATENT DOCUMENTS

| | | | | |
|---|---|---|---|---|
| 2009/0074440 | A1 | 3/2009 | Nanno et al. | |
| 2010/0034548 | A1 | 2/2010 | Naitoh et al. | |
| 2010/0232848 | A1 | 9/2010 | Naitoh | |
| 2011/0026944 | A1 | 2/2011 | Naitoh | |
| 2011/0217094 | A1* | 9/2011 | Hasegawa | 399/329 |
| 2012/0020681 | A1 | 1/2012 | Naitoh et al. | |
| 2012/0177422 | A1 | 7/2012 | Nanno et al. | |
| 2012/0275834 | A1 | 11/2012 | Naitoh et al. | |
| 2013/0064586 | A1 | 3/2013 | Adachi et al. | |
| 2013/0195522 | A1* | 8/2013 | Kasama | 399/329 |

OTHER PUBLICATIONS

U.S. Appl. No. 14/040,866, filed Sep. 30, 2013.
U.S. Appl. No. 14/017,383, filed Sep. 4, 2013.
U.S. Appl. No. 13/953,966, filed Jul. 30, 2013.
U.S. Appl. No. 14/012,340, filed Aug. 28, 2013.

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2012-266292, filed on Dec. 5, 2012, in the Japanese Patent Office, the entire disclosure of which is hereby incorporated by reference herein.

BACKGROUND

1. Technical Field

Example embodiments generally relate to a fixing device and an image forming apparatus, and more particularly, to a fixing device for fixing a toner image on a recording medium and an image forming apparatus incorporating the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include an endless belt having a decreased thermal capacity to shorten a warm-up time taken to warm up the fixing device to a desired fixing temperature and a first print time taken to output the first recording medium bearing the fixed toner image upon receipt of a print job.

For example, the belt is formed into a loop inside which a heater is situated. A pressing roller situated outside the loop formed by the belt is pressed against the belt to form a fixing nip between the pressing roller and the belt. As the belt and the pressing roller rotate and convey the recording medium through the fixing nip, the belt and the pressing roller apply heat and pressure to the recording medium, fixing the toner image on the recording medium.

As the pressing roller rotates, the pressing roller drives and rotates the belt by friction therebetween. Accordingly, as the belt slips on the pressing roller, the belt may apply an unstable brake to the recording medium conveyed through the fixing nip, creasing the recording medium.

To address this circumstance, JP-H09-197864-A discloses the pressing roller having the diameter that increases continuously from a center to each lateral end in an axial direction of the pressing roller, thus increasing the conveyance speed of the recording medium conveyed over each lateral end of the pressing roller relative to the conveyance speed of the recording medium conveyed over the center of the pressing roller. Accordingly, tension exerted on the recording medium is directed from the center to each lateral end of the pressing roller in the axial direction thereof, preventing the recording medium from creasing.

Before the recording medium is conveyed through the fixing nip, tension exerted on the recording medium is directed from the center to each lateral end of the pressing roller in the axial direction thereof. Conversely, however, while the recording medium is conveyed through the fixing nip, tension exerted on the recording medium is directed from each lateral end to the center of the pressing roller in the axial direction thereof.

Accordingly, as tension directed from each lateral end to the center of the pressing roller in the axial direction thereof is exerted on the recording medium, it may crease the recording medium while the recording medium is conveyed through a downstream position in the fixing nip situated downstream from a center of the fixing nip in a recording medium conveyance direction.

SUMMARY

At least one embodiment provides a novel fixing device that includes an endless belt rotatable in a given direction of rotation and a heater disposed opposite and heating the endless belt. The nip formation pad is disposed opposite an inner circumferential surface of the endless belt. A pressing rotary body is pressed against the nip formation pad via the endless belt to form a fixing nip between the endless belt and the pressing rotary body, through which a recording medium is conveyed. The pressing rotary body has a diameter increasing from a center to each lateral end in an axial direction thereof. The nip formation pad includes a projection disposed downstream from a rotation axis of the pressing rotary body in a recording medium conveyance direction. The projection projects toward the pressing rotary body in an amount increasing from each lateral end to a center in a longitudinal direction of the nip formation pad parallel to the axial direction of the pressing rotary body.

At least one embodiment provides a novel image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
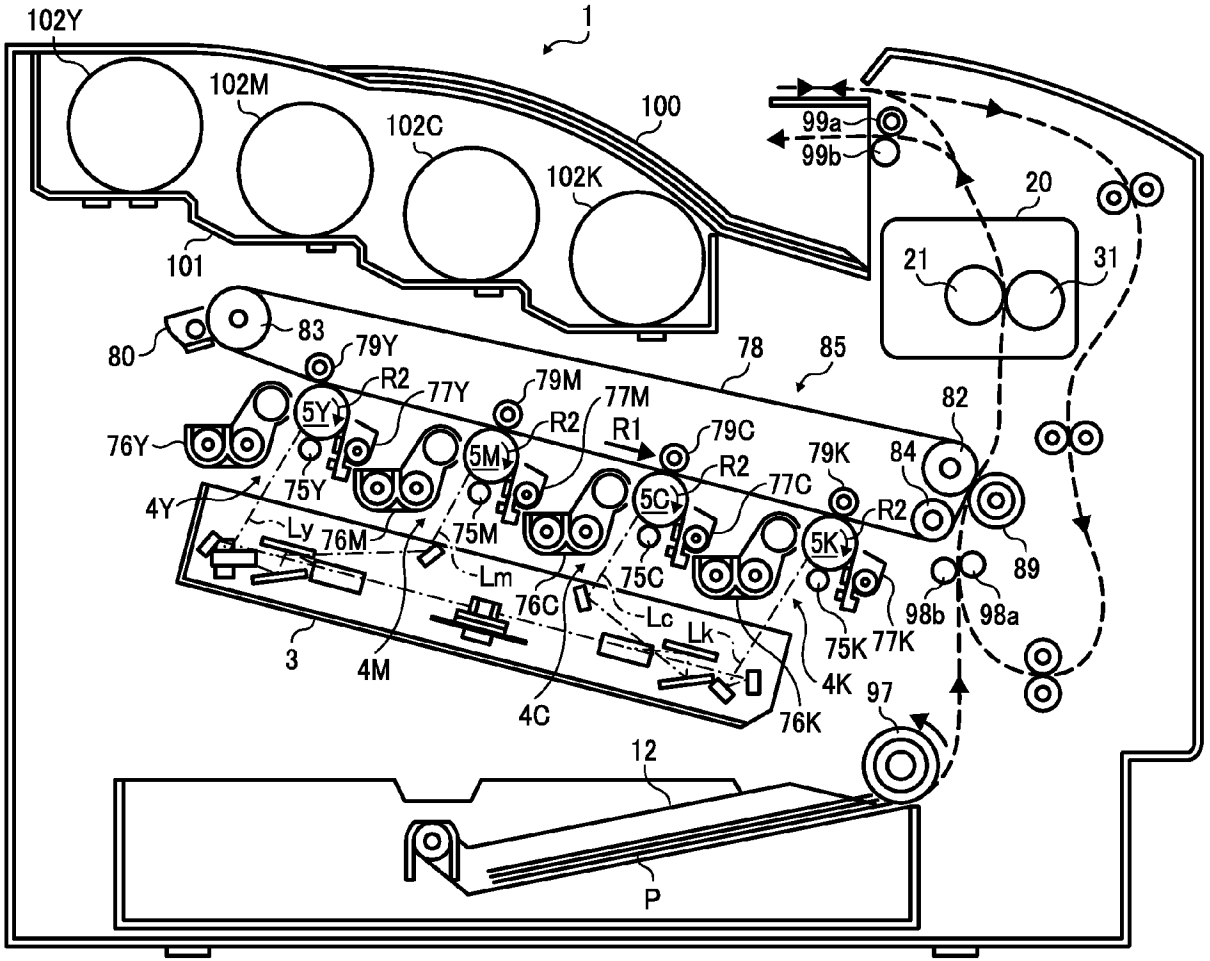
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a tandem color printer that forms color and monochrome toner images on recording media by electrophotography.

As shown in FIG. 1, the image forming apparatus 1 includes four image forming devices 4Y, 4M, 4C, and 4K that form yellow, magenta, cyan, and black toner images, respectively; a paper tray 12 situated below the image forming devices 4Y, 4M, 4C, and 4K; an intermediate transfer unit 85 situated above the image forming devices 4Y, 4M, 4C, and 4K; a fixing device 20 situated above the intermediate transfer unit 85; and a bottle holder 101 situated above the intermediate transfer unit 85.

The bottle holder 101 disposed in an upper portion of the image forming apparatus 1 holds four toner bottles 102Y, 102M, 102C, and 102K containing fresh yellow, magenta, cyan, and black toners, respectively, and detachably attached to the bottle holder 101.

The intermediate transfer unit 85 situated below the bottle holder 101 includes an intermediate transfer belt 78, four primary transfer bias rollers 79Y, 79M, 79C, and 79K, a secondary transfer backup roller 82, a cleaning backup roller 83, a tension roller 84, and an intermediate transfer belt cleaner 80.

The image forming devices 4Y, 4M, 4C, and 4K are disposed opposite the intermediate transfer belt 78 and aligned along a rotation direction R1 of the intermediate transfer belt 78. The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, cleaners 77Y, 77M, 77C, and 77K, and dischargers, respectively.

A detailed description is now given of image forming processes performed on the photoconductive drums 5Y, 5M, 5C, and 5K.

A driver (e.g., a motor) drives and rotates the photoconductive drums 5Y, 5M, 5C, and 5K clockwise in FIG. 1 in a rotation direction R2. The image forming devices 4Y, 4M, 4C, and 4K perform image forming processes including a charging process, an exposure process, a development process, a primary transfer process, and a cleaning process on the photoconductive drums 5Y, 5M, 5C, and 5K as the photoconductive drums 5Y, 5M, 5C, and 5K rotate clockwise in FIG. 1 in the rotation direction R2.

In the charging process, the chargers 75Y, 75M, 75C, and 75K disposed opposite the photoconductive drums 5Y, 5M, 5C, and 5K, respectively, uniformly charge an outer circumferential surface of the respective photoconductive drums 5Y, 5M, 5C, and 5K.

In the exposure process, an exposure device 3 disposed opposite the photoconductive drums 5Y, 5M, 5C, and 5K emits laser beams Ly, Lm, Lc, and Lk onto the charged outer circumferential surface of the respective photoconductive drums 5Y, 5M, 5C, and 5K. The laser beams Ly, Lm, Lc, and Lk scan and expose the outer circumferential surface of the respective photoconductive drums 5Y, 5M, 5C, and 5K, forming electrostatic latent images thereon according to yellow, magenta, cyan, and black image data of color image data sent from an external device such as a client computer.

In the development process, the development devices 76Y, 76M, 76C, and 76K disposed opposite the photoconductive drums 5Y, 5M, 5C, and 5K visualize the electrostatic latent images formed on the photoconductive drums 5Y, 5M, 5C, and 5K with yellow, magenta, cyan, and black toners supplied from the toner bottles 102Y, 102M, 102C, and 102K into yellow, magenta, cyan, and black toner images, respectively.

Thus, the yellow, magenta, cyan, and black toner images are formed on the photoconductive drums 5Y, 5M, 5C, and 5K, respectively.

The photoconductive drums 5Y, 5M, 5C, and 5K are disposed opposite the primary transfer bias rollers 79Y, 79M, 79C, and 79K via the intermediate transfer belt 78 to form primary transfer nips between the intermediate transfer belt 78 and the photoconductive drums 5Y, 5M, 5C, and 5K, respectively. In the primary transfer process, the primary transfer bias rollers 79Y, 79M, 79C, and 79K primarily transfer the yellow, magenta, cyan, and black toner images formed on the photoconductive drums 5Y, 5M, 5C, and 5K onto the intermediate transfer belt 78. After the primary transfer process, a slight amount of residual toner failed to be transferred onto the intermediate transfer belt 78 remains on the photoconductive drums 5Y, 5M, 5C, and 5K. To address this circumstance, in the cleaning process, a cleaning blade of the respective cleaners 77Y, 77M, 77C, and 77K disposed opposite the photoconductive drums 5Y, 5M, 5C, and 5K mechanically collects the residual toner from the photoconductive drums 5Y, 5M, 5C, and 5K, respectively.

Finally, the dischargers disposed opposite the photoconductive drums 5Y, 5M, 5C, and 5K remove residual potential from the photoconductive drums 5Y, 5M, 5C, and 5K, respectively. After the image forming processes described above, a color toner image is formed on the intermediate transfer belt 78.

The intermediate transfer belt 78 is stretched taut across and supported by the secondary transfer backup roller 82, the cleaning backup roller 83, and the tension roller 84. The four primary transfer bias rollers 79Y, 79M, 79C, and 79K and the photoconductive drums 5Y, 5M, 5C, and 5K sandwich the intermediate transfer belt 78 to form the primary transfer nips between the photoconductive drums 5Y, 5M, 5C, and 5K and the intermediate transfer belt 78. A transfer bias having a polarity opposite a polarity of toner is applied to the primary transfer bias rollers 79Y, 79M, 79C, and 79K.

As the secondary transfer backup roller 82 drives and rotates the intermediate transfer belt 78 in the rotation direction R1, the intermediate transfer belt 78 passes through the primary transfer nips formed between the photoconductive drums 5Y, 5M, 5C, and 5K and the intermediate transfer belt 78 successively. Accordingly, the yellow, magenta, cyan, and black toner images formed on the photoconductive drums 5Y, 5M, 5C, and 5K are primarily transferred onto the intermediate transfer belt 78 such that the yellow, magenta, cyan, and black toner images are superimposed on a same position on the intermediate transfer belt 78, thus forming the color toner image on the intermediate transfer belt 78.

A detailed description is now given of a secondary transfer process performed on the intermediate transfer belt 78.

A secondary transfer bias roller 89 is disposed opposite the secondary transfer backup roller 82 via the intermediate transfer belt 78 to form a secondary transfer nip between the secondary transfer bias roller 89 and the intermediate transfer belt 78. As the color toner image formed on the intermediate transfer belt 78 moves through the secondary transfer nip, the secondary transfer bias roller 89 secondarily transfers the color toner image formed on the intermediate transfer belt 78 onto a recording medium P conveyed through the secondary transfer nip in the secondary transfer process. After the secondary transfer process, the intermediate transfer belt cleaner 80 disposed opposite the intermediate transfer belt 78 collects residual toner failed to be transferred onto the recording medium P and therefore remaining on the intermediate transfer belt 78 therefrom.

The paper tray 12 situated in a lower portion of the image forming apparatus 1 loads a plurality of recording media P (e.g., transfer sheets) such that the plurality of recording media P is layered on the paper tray 12.

Next, a detailed description is given of conveyance of the recording medium P from the paper tray 12.

As a feed roller 97 is driven and rotated counterclockwise in FIG. 1, an uppermost recording medium P of the plurality of recording media P loaded on the paper tray 12 is conveyed to a roller nip formed between registration rollers 98*a* and 98*b*. As the recording medium P comes into contact with the registration rollers 98*a* and 98*b*, the registration rollers 98*a* and 98*b* that stop their rotation halt the recording medium P temporarily at the roller nip formed between the registration rollers 98*a* and 98*b*. At a time when the color toner image formed on the intermediate transfer belt 78 reaches the secondary transfer nip, the registration rollers 98*a* and 98*b* resume their rotation to feed the recording medium P to the secondary transfer nip. Hence, as the recording medium P travels through the secondary transfer nip, the color toner image formed on the intermediate transfer belt 78 is secondarily transferred onto the recording medium P.

Thereafter, the recording medium P bearing the color toner image is conveyed to the fixing device 20. As the recording medium P is conveyed between a fixing belt 21 and a pressing roller 31 of the fixing device 20, the fixing belt 21 and the pressing roller 31 apply heat and pressure to the recording medium P, fixing the color toner image on the recording medium P. The recording medium P bearing the fixed color toner image is conveyed through output rollers 99*a* and 99*b* and discharged and stacked onto an outside of the image forming apparatus 1, that is, an output tray 100 disposed atop the image forming apparatus 1. Thus, a series of image forming processes performed by the image forming apparatus 1 is completed.

Figure 2:
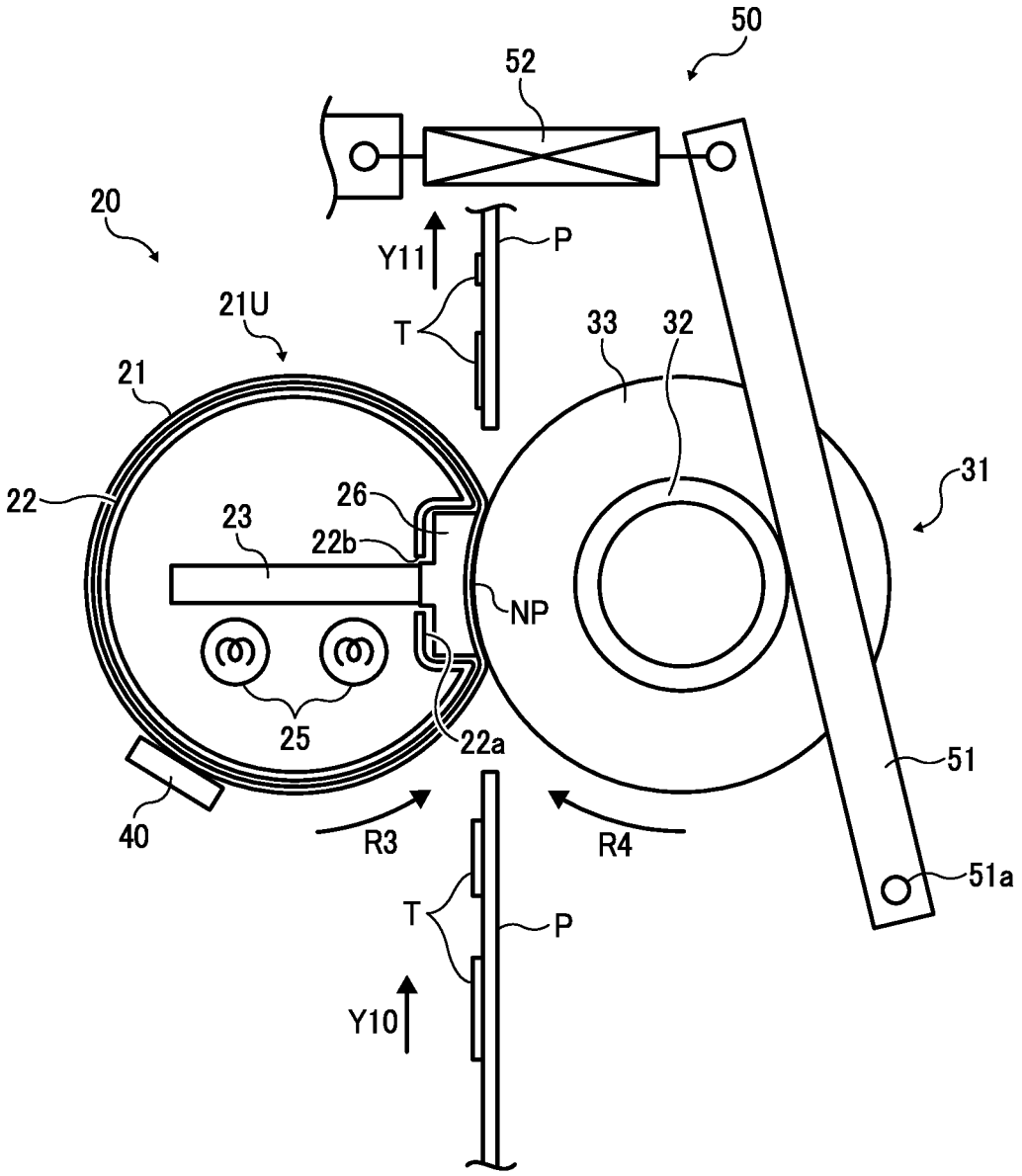
FIG. 2 is a vertical sectional view of a fixing device incorporated in the image forming apparatus shown in FIG. 1.

With reference to FIG. 2, a description is provided of a construction of the fixing device 20 incorporated in the image forming apparatus 1 described above.

FIG. 2 is a vertical sectional view of the fixing device 20. As shown in FIG. 2, the fixing device 20 (e.g., a fuser) includes the fixing belt 21 serving as an endless belt formed into a loop and rotatable in a rotation direction R3; a thermal conductor 22 disposed opposite an inner circumferential surface of the fixing belt 21; a nip formation pad 26 disposed inside the loop formed by the fixing belt 21 such that the nip formation pad 26 is disposed opposite the inner circumferential surface of the fixing belt 21; a support 23, disposed inside the loop formed by the fixing belt 21 such that the support 23 is disposed opposite the inner circumferential surface of the fixing belt 21 via the thermal conductor 22, to contact and support the nip formation pad 26; a heater 25, disposed inside the loop formed by the fixing belt 21 such that the heater 25 is disposed opposite the inner circumferential surface of the fixing belt 21 via the thermal conductor 22, to heat the fixing belt 21 through the thermal conductor 22; the pressing roller 31 serving as a pressing rotary body pressed against the nip formation pad 26 via the fixing belt 21 to form a fixing nip NP between the pressing roller 31 and the fixing belt 21 and rotatable in a rotation direction R4 counter to the rotation direction R3 of the fixing belt 21; a temperature sensor 40 disposed opposite an outer circumferential surface of the fixing belt 21 to detect the temperature of the fixing belt 21; and a pressurization assembly 50 pressing the pressing roller 31 against the fixing belt 21.

The fixing belt 21 and the components disposed inside the loop formed by the fixing belt 21, that is, the thermal conductor 22, the nip formation pad 26, the support 23, and the heater 25, may constitute a belt unit 21U separably coupled with the pressing roller 31. The fixing device 20 may further include a first stay, a second stay, and a low-friction sheet disposed inside the loop formed by the fixing belt 21.

A detailed description is now given of a construction of the fixing belt 21.

The fixing belt 21 is a thin, flexible endless belt looped over no component and therefore bendable flexibly. The fixing belt 21, as it receives a driving force from the pressing roller 31, rotates counterclockwise in FIG. 2 in the rotation direction R3. It is to be noted that the "endless belt" defines a seamless belt produced by bonding both circumferential ends of the belt. For example, the fixing belt 21, having a thickness of about 1 mm or smaller, is constructed of a base layer constituting the inner circumferential surface of the fixing belt 21; an elastic layer coating the base layer; and a surface release layer coating the elastic layer.

The base layer, having a thickness in a range of from about 30 micrometers to about 100 micrometers, is made of metal such as nickel and stainless steel or resin such as polyimide. However, the configuration of the base layer of the fixing belt 21 is not limited to the above. If the fixing belt 21 is made of resin such as polyimide, the fixing belt 21 has a decreased rigidity and therefore is susceptible to bending at a position downstream from the fixing nip NP in a recording medium conveyance direction Y10. Hence, the fixing belt 21 facilitates separation of a recording medium P discharged from the fixing nip NP from the fixing belt 21.

The elastic layer, having a thickness in a range of from about 100 micrometers to about 300 micrometers, is made of rubber such as silicone rubber, silicone rubber foam, and fluoro rubber. However, the configuration of the elastic layer of the fixing belt 21 is not limited to the above. The elastic layer absorbs slight surface asperities of the fixing belt 21 at the fixing nip NP when the pressing roller 31 is pressed against the nip formation pad 26 via the fixing belt 21, facilitating even conduction of heat from the fixing belt 21 to a toner image T on a recording medium P passing through the fixing nip NP. Accordingly, the elastic layer of the fixing belt 21 suppresses formation of an orange peel image on the recording medium P. The orange peel image defines a faulty toner image having many slight surface asperities.

The release layer, having a thickness in a range of from about 10 micrometers to about 50 micrometers, is made of tetrafluoroethylene-perfluoroalkylvinylether copolymer (PFA), polytetrafluoroethylene (PTFE), polyimide, polyether imide, polyether sulfone (PES), or the like. However, the configuration of the release layer of the fixing belt 21 is not limited to the above. The release layer facilitates separation of the toner image T on the recording medium P from the fixing belt 21. A loop diameter of the fixing belt 21 is in a range of from about 15 mm to about 120 mm. According to this example embodiment, the loop diameter of the fixing belt 21 is about 30 mm. However, the loop diameter of the fixing belt 21 is not limited to the above. Separation facilitated by the release layer defines separation of substances adhered to each other that is performed readily.

A detailed description is now given of a configuration of the nip formation pad 26.

The nip formation pad 26 is stationarily disposed inside the loop formed by the fixing belt 21 and in contact with the inner circumferential surface of the fixing belt 21 such that the fixing belt 21 slides over an outer surface of the stationary nip formation pad 26. The nip formation pad 26 presses against the pressing roller 31 via the fixing belt 21 to form the fixing nip NP between the fixing belt 21 and the pressing roller 31 through which the recording medium P bearing the toner image T is conveyed. A detailed description of a construction of the nip formation pad 26 is deferred.

A detailed description is now given of a configuration of the thermal conductor 22.

Both lateral ends of the thermal conductor 22 in a longitudinal direction thereof parallel to an axial direction of the fixing belt 21 are mounted on and supported by side plates of the fixing device 20, respectively. The thermal conductor 22 is a tube or a pipe having a thickness not greater than about 0.2 mm. However, the configuration of the thermal conductor 22 is not limited to the above. For example, the thermal conductor 22 is made of heat conductive metal such as aluminum, iron, and stainless steel. The thermal conductor 22 having a thickness not greater than about 0.2 mm improves heating efficiency for heating the fixing belt 21. The thermal conductor 22 is disposed in proximity to or in contact with the inner circumferential surface of the fixing belt 21 in a circumferential span other than the fixing nip NP. Conversely, at the fixing nip NP, the thermal conductor 22 creates a recess 22*a* accommodating the nip formation pad 26 and being produced with a slit 22*b*. In order to reduce abrasion of the fixing belt 21 sliding over the thermal conductor 22, a lubricant such as fluorine grease and silicone oil is applied between the fixing belt 21 and the thermal conductor 22.

As the thermal conductor 22 is heated by radiation heat and light (hereinafter referred to as radiation heat) from the heater 25, the thermal conductor 22 in turn heats the fixing belt 21. That is, the heater 25 heats the thermal conductor 22 directly and the fixing belt 21 indirectly through the thermal conductor 22. That is, as the thermal conductor 22 heats the fixing belt 21 throughout substantially the entire circumferential span of the fixing belt 21 other than the fixing nip NP, the fixing belt 21 in turn conducts heat to the toner image T on the recording medium P from the outer circumferential surface of the fixing belt 21.

A gap in a range of from about 0 mm to about 1 mm is provided between the fixing belt 21 and the thermal conductor 22 in the circumferential span other than the fixing nip NP at ambient temperature. However, the configuration of the thermal conductor 22 is not limited to the above. Accordingly, the fixing belt 21 slides over the thermal conductor 22 in an increased area, decelerating abrasion or wear of the fixing belt 21. Additionally, the fixing belt 21 is not isolated from the thermal conductor 22 excessively, suppressing degradation in heating efficiency for heating the fixing belt 21. The thermal conductor 22 disposed in proximity to the fixing belt 21 maintains the substantially circular loop of the flexible fixing belt 21, preventing or reducing deformation of the fixing belt 21 and resultant abrasion and wear of the fixing belt 21.

A detailed description is now given of a configuration of the heater 25.

The heater 25 includes a halogen heater, a carbon heater, or the like. Both lateral ends of the heater 25 in a longitudinal direction thereof parallel to the axial direction of the fixing belt 21 are mounted on the side plates of the fixing device 20, respectively. The temperature sensor 40 disposed opposite the outer circumferential surface of the fixing belt 21 detects the temperature of the outer circumferential surface of the fixing belt 21. A controller, that is, a central processing unit (CPU), provided with a random-access memory (RAM) and a read-only memory (ROM), for example, operatively connected to the temperature sensor 40 and the heater 25 controls the heater 25 based on the temperature of the outer circumferential surface of the fixing belt 21 detected by the temperature sensor 40. Thus, the controller controls the heater 25 to heat the fixing belt 21 to a desired fixing temperature at which the color toner image T is fixed on the recording medium P. For example, the temperature sensor 40 includes a thermistor.

A detailed description is now given of a configuration of the support 23.

The support 23 is stationarily situated inside the loop formed by the fixing belt 21 such that the support 23 is disposed opposite the inner circumferential surface of the fixing belt 21. The support 23 contacts the nip formation pad 26 to support and reinforce the nip formation pad 26 against pressure from the pressing roller 31. A length of the support 23 in a longitudinal direction thereof parallel to the axial direction of the fixing belt 21 is equivalent to a length of the nip formation pad 26 in a longitudinal direction thereof parallel to the axial direction of the fixing belt 21. The support 23 presses against the pressing roller 31 via the nip formation pad 26 and the fixing belt 21, supporting the nip formation pad 26 against pressure from the pressing roller 31 at the fixing nip NP and thereby protecting the nip formation pad 26 from substantial deformation by pressure from the pressing roller 31. A detailed description of a construction of the support 23 is deferred.

A detailed description is now given of a construction of the pressing roller 31.

The pressing roller 31 serving as a pressing rotary body contacts the outer circumferential surface of the fixing belt 21 at the fixing nip NP. The pressing roller 31 having a diameter in a range of from about 20 mm to about 40 mm is constructed of a heat-resistant, hollow metal core 32 and an elastic layer 33 coating the metal core 32. However, the construction of the pressing roller 31 is not limited to the above. The pressing roller 31 mounts a gear engaging a gear train connected to a driver that drives and rotates the pressing roller 31 clockwise in FIG. 2 in the rotation direction R4. Both lateral ends of the pressing roller 31 in an axial direction thereof are rotatably supported by the side plates of the fixing device 20 through bearings, respectively.

The elastic layer 33 of the pressing roller 31 is made of silicone rubber foam, silicone rubber, fluoro rubber, or the like. Optionally, a thin, surface release layer made of a material that facilitates separation of the recording medium P from the pressing roller 31, such as PFA and PTFE, may coat the elastic layer 33.

A detailed description is now given of a construction of the pressurization assembly 50.

The pressurization assembly 50 separably presses the pressing roller 31 against the fixing belt 21. The pressurization assembly 50 includes a lever 51 and a spring 52. The lever 51 is pivotable about a shaft 51*a* situated at one end of the lever 51 in a longitudinal direction thereof and mounted on the side plate of the fixing device 20. A center of the lever 51 in the longitudinal direction thereof contacts a bearing that bears the pressing roller 31 and movably engages an elongate hole produced in the side plate of the fixing device 20. The spring 52 is anchored to another end of the lever 51 in the longitudinal direction thereof. During a fixing job, as the driver causes the lever 51 to pivot about the shaft 51*a*, the lever 51 presses the pressing roller 31 against the fixing belt 21, forming the desired fixing nip NP therebetween.

With reference to FIGS. 1 and 2, a description is provided of a fixing operation of the fixing device 20 having the configuration described above to fix a toner image T on a recording medium P.

As a power switch of the image forming apparatus 1 is turned on, power is supplied to the heater 25. Simultaneously, a driver drives and rotates the pressing roller 31 in the rotation direction R4. Accordingly, the fixing belt 21 rotates in the rotation direction R3 in accordance with rotation of the pressing roller 31 by friction therebetween at the fixing nip NP. Alternatively, the driver may be connected to the fixing belt 21 to drive and rotate it or connected to both the pressing roller 31 and the fixing belt 21 to drive and rotate them. Thereafter, as a recording medium P conveyed from the paper tray 12 depicted in FIG. 1 reaches the secondary transfer nip, the secondary transfer bias roller 89 secondarily transfers a toner image T formed on the intermediate transfer belt 78 onto the recording medium P.

The recording medium P bearing the toner image T is conveyed in the recording medium conveyance direction Y10 while guided by a guide plate and enters the fixing nip NP formed between the fixing belt 21 and the pressing roller 31 pressed against the fixing belt 21. As the recording medium P is conveyed through the fixing nip NP, the recording medium P receives heat from the fixing belt 21 heated by the heater 25 through the heat conductor 22 and pressure from the fixing belt 21 and the pressing roller 31 pressed against the nip formation pad 26 supported by the support 23 via the fixing belt 21. Thus, the toner image T is fixed on the recording medium P by the heat and pressure. Thereafter, the recording medium P bearing the fixed toner image T is discharged from the fixing nip NP and conveyed in a recording medium conveyance direction Y11, completing a series of fixing processes performed by the fixing device 20.

With reference to FIGS. 3 to 6, a description is provided of a relation between the nip formation pad 26 and the pressing roller 31 pressed against the nip formation pad 26 via the fixing belt 21.

Figure 3:
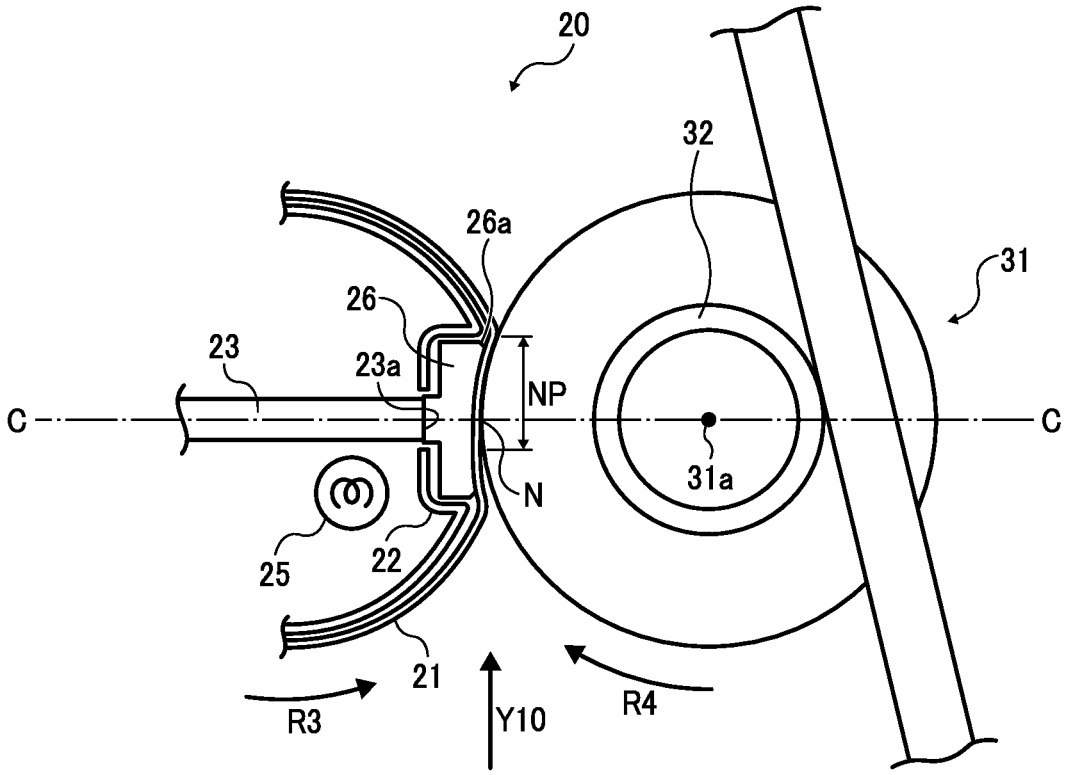
FIG. 3 is an enlarged partial vertical sectional view of the fixing device shown in FIG. 2.
Figure 4:
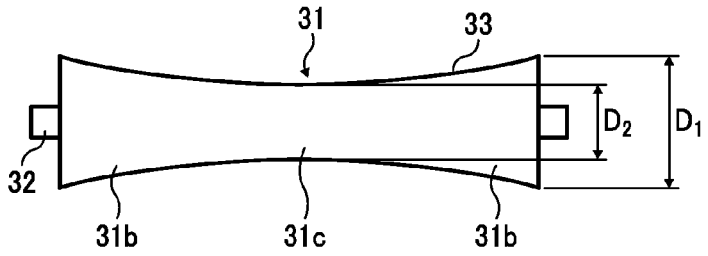
FIG. 4 is a schematic side view of a pressing roller incorporated in the fixing device shown in FIG. 2.
Figure 5:
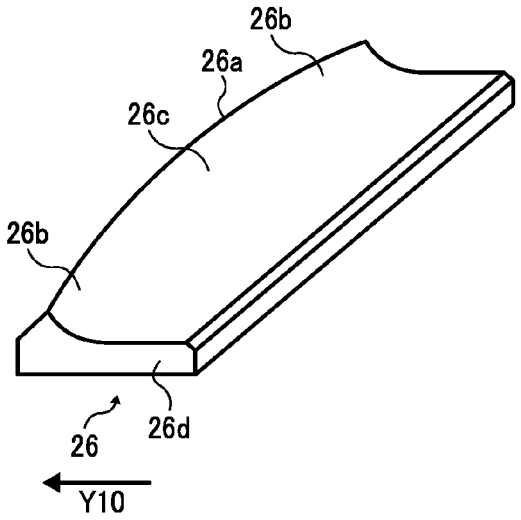
FIG. 5 is a perspective view of a nip formation pad incorporated in the fixing device shown in FIG. 2.

FIG. 3 is an enlarged partial vertical sectional view of the fixing device 20. FIG. 4 is a schematic side view of the pressing roller 31. FIG. 5 is a perspective view of the nip formation pad 26.

As shown in FIG. 3, the pressing roller 31 presses the fixing belt 21 against the nip formation pad 26 to form the fixing nip NP between the pressing roller 31 and the fixing belt 21. A center N of the fixing nip NP in the recording medium conveyance direction Y10 is on an extension C passing through a rotation axis 31*a* of the pressing roller 31.

As shown in FIG. 4, the pressing roller 31 has an inverted crown shape. The inverted crown shape is defined by the diameter of the pressing roller 31 that increases from a center 31*c* to each lateral end 31*b* of the pressing roller 31 in a longitudinal direction parallel to the axial direction thereof. The inverted crown shape of the pressing roller 31 is produced with an identical outer diameter of the metal core 32 and a thickness of the elastic layer 33 increasing from the center 31*c* to each lateral end 31*b* of the pressing roller 31 in the axial direction thereof. A lateral end diameter D1 of the pressing roller 31 is greater than a center diameter D2 of the pressing roller 31 by a range of from about 50 micrometers to about 200 micrometers. However, the configuration of the diameter of the pressing roller 31 is not limited to the above.

The pressing roller 31 having the inverted crown shape presses the fixing belt 21 against the nip formation pad 26 with increased pressure at each lateral end 31*b* of the pressing roller 31 and decreased pressure at the center 31*c* of the pressing roller 31 in the axial direction thereof. Accordingly, the recording medium P is conveyed through the fixing nip NP at each lateral end 31*b* of the pressing roller 31 in the axial direction thereof at a conveyance speed higher than a conveyance speed at the center 31*c* of the pressing roller 31 in the axial direction thereof. Consequently, before the recording medium P is conveyed through the fixing nip NP, the recording medium P is exerted with tension directed from the center 31*c* to each lateral end 31*b* of the pressing roller 31 in the axial direction thereof, which prevents the recording medium P from creasing.

As shown in FIG. 3, a length of the nip formation pad 26 is greater than a length of the fixing nip NP in the recording medium conveyance direction Y10. As shown in FIG. 5, the nip formation pad 26 includes a body 26*d* and a projection 26*a* projecting from the body 26*d* toward the pressing roller 31 in a direction perpendicular to the recording medium conveyance direction Y10. As shown in FIG. 3, the projection 26*a* is situated downstream from the center N of the fixing nip NP in the recording medium conveyance direction Y10.

Since the length of the nip formation pad 26 is greater than the length of the fixing nip NP in the recording medium conveyance direction Y10, an outer circumferential surface of the pressing roller 31 is not snagged or caught on a corner of the nip formation pad 26. As the outer circumferential surface of the pressing roller 31 is snagged or caught on the corner of the nip formation pad 26 at the position downstream from the center N of the fixing nip NP in the recording medium conveyance direction Y10, pressure exerted on the recording medium P by the pressing roller 31 may vary in the axial direction of the pressing roller 31. To address this circumstance, the nip formation pad 26 according to this example embodiment prevents the outer circumferential surface of the pressing roller 31 from being snagged or caught on the corner of the nip formation pad 26, thus preventing the recording medium P from creasing.

As shown in FIG. 5, the projection 26*a* of the nip formation pad 26 is curved along the recording medium conveyance direction Y10 and arc-shaped along the longitudinal direction of the nip formation pad 26 parallel to the axial direction of the pressing roller 31. Accordingly, the arc-shaped projection 26*a* of the nip formation pad 26 presses the fixing belt 21 and the recording medium P against the pressing roller 31 with increased pressure at the center 31*c* of the pressing roller 31 in the axial direction thereof and with decreased pressure at each lateral end 31*b* of the pressing roller 31 in the axial direction thereof. Consequently, at the position downstream from the center N of the fixing nip NP in the recording medium conveyance direction Y10, the fixing belt 21 and the recording medium P engage the pressing roller 31 more at the center 31*c* of the pressing roller 31 in the axial direction thereof than at each lateral end 31*b* of the pressing roller 31 in the axial direction thereof.

Since the protrusion 26*a* of the nip formation pad 26 presses the fixing belt 21 and the recording medium P against the pressing roller 31 with increased pressure at the center 31*c* of the pressing roller 31 in the axial direction thereof, the difference between pressure exerted by the protrusion 26*a* of the nip formation pad 26 at the center 31*c* of the pressing roller 31 and pressure exerted by the protrusion 26*a* of the nip formation pad 26 at each lateral end 31*b* of the pressing roller 31 decreases at the position downstream from the center N of the fixing nip NP in the recording medium conveyance direction Y10. Accordingly, the protrusion 26*a* of the nip formation pad 26 reduces tension exerted on the recording medium P at the fixing nip NP and directed from each lateral end 31*b* to the center 31*c* of the pressing roller 31 in the axial direction thereof, preventing the recording medium P from creasing as the recording medium P is conveyed through the fixing nip NP.

Figure 6:
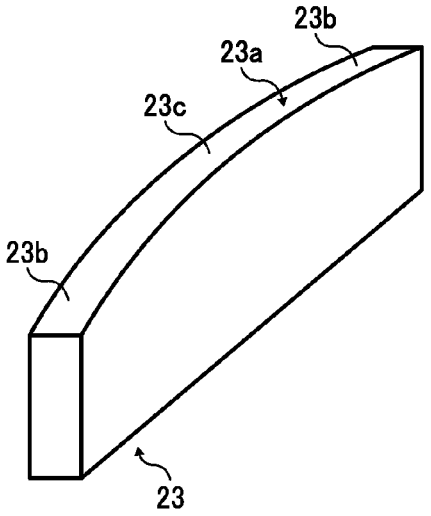
FIG. 6 is a perspective view of a support incorporated in the fixing device shown in FIG. 2.

With reference to FIGS. 3 and 6, a description is provided of a relation between the nip formation pad 26 and the support 23 supporting the nip formation pad 26.

FIG. 6 is a perspective view of the support 23. As shown in FIG. 3, the support 23, extending along the extension C extending in the direction perpendicular to the recording medium conveyance direction Y10 and passing through the rotation axis 31*a* of the pressing roller 31, includes a support face 23*a* contacting and supporting the nip formation pad 26. The support 23 is made of metal such as stainless steel. The support 23 made of metal supports the nip formation pad 26 against pressure from the pressing roller 31, suppressing bending of the nip formation pad 26 that may be caused by pressure from the pressing roller 31.

As shown in FIG. 6, the support face 23*a* of the support 23 is arc-shaped along the longitudinal direction of the support 23 such that a center 23*c* of the support face 23*a* in the longitudinal direction of the support 23 projects toward the nip formation pad 26 farther than both lateral ends 23*b* of the support face 23*a* in the longitudinal direction of the support 23. Accordingly, as the nip formation pad 26 receives pressure from the pressing roller 31, the nip formation pad 26 is bent along the arc-shaped support face 23*a* of the support 23. The bent nip formation pad 26 concentrates pressure from the pressing roller 31 on the center 26*c* of the nip formation pad 26 and the center 31*c* of the pressing roller 31 in the longitudinal direction thereof, bending the pressing roller 31 to correspond to bending of the nip formation pad 26.

As the nip formation pad 26 and the pressing roller 31 are bent, the area where the pressing roller 31 is pressed against the nip formation pad 26 via the fixing belt 21 is greater at each lateral end 26*b* of the nip formation pad 26 and each lateral end 31*b* of the pressing roller 31 in the longitudinal direction thereof than at the center 26*c* of the nip formation pad 26 and the center 31*c* of the pressing roller 31 in the longitudinal direction thereof. That is, the length of the fixing nip NP in the recording medium conveyance direction Y10 decreases continuously from each lateral end 26*b* of the nip formation pad 26 and each lateral end 31*b* of the pressing roller 31 to the center 26*c* of the nip formation pad 26 and the center 31*c* of the pressing roller 31 in the longitudinal direction thereof. Accordingly, the toner image T is fixed on the recording medium P with fixing quality that is even throughout the longitudinal direction of the pressing roller 31, thus preventing faulty fixing or variation in gloss of the toner image T fixed on the recording medium P.

A description is provided of advantages of the fixing device 20.

As shown in FIG. 2, the fixing device 20 includes the fixing belt 21 serving as an endless belt formed into a loop produced by bonding both ends thereof. The heater 25 is disposed inside the loop formed by the fixing belt 21 such that the heater 25 is disposed opposite the inner circumferential surface of the fixing belt 21. The pressing roller 31 serves as a pressing rotary body separably contacting the fixing belt 21 and rotatable while contacting the fixing belt 21. The nip formation pad 26, disposed inside the loop formed by the fixing belt 21 such that the nip formation pad 26 is disposed opposite the inner circumferential surface of the fixing belt 21, presses the fixing belt 21 against the pressing roller 31 to form the fixing nip NP between the fixing belt 21 and the pressing roller 31. As the recording medium P bearing the toner image T is conveyed through the fixing nip NP, the fixing belt 21 and the pressing roller 31 apply heat and pressure to the recording medium P, fixing the toner image T on the recording medium P. As shown in FIG. 4, the diameter of the pressing roller 31 increases from the center 31*c* to each lateral end 31*b* in the longitudinal direction thereof. As shown in FIG. 3, the projection 26*a* of the nip formation pad 26 is disposed downstream from the rotation axis 31*a* of the pressing roller 31 in the recording medium conveyance direction Y10. As shown in FIG. 5, the projection 26*a* of the nip formation pad 26 projects in the direction perpendicular to the recording medium conveyance direction Y10 in an amount increasing from each lateral end 26*b* to the center 26*c* of the projection 26*a* in the longitudinal direction of the nip formation pad 26.

Accordingly, before the recording medium P is conveyed through the fixing nip NP, the recording medium P is exerted with a constant tension directed from the center 31*c* to each lateral end 31*b* of the pressing roller 31 in the axial direction thereof. Conversely, as the recording medium P is conveyed through the fixing nip NP, the recording medium P is exerted with a decreased tension directed from each lateral end 31*b* to the center 31*c* of the pressing roller 31 in the axial direction thereof.

A detailed description is now given of the advantages of the fixing device 20.

As shown in FIG. 2, the fixing belt 21 is an endless belt produced by bonding both ends thereof and accommodating the heater 25. The pressing roller 31 rotates in the rotation direction R4 while contacting the fixing belt 21. The nip formation pad 26 disposed opposite the inner circumferential surface of the fixing belt 21 presses the fixing belt 21 against the pressing roller 31 to form the fixing nip NP between the fixing belt 21 and the pressing roller 31. As the recording medium P bearing the toner image T is conveyed through the fixing nip NP, the fixing belt 21 and the pressing roller 31 apply heat and pressure to the recording medium P, fixing the toner image T on the recording medium P.

As shown in FIG. 4, the diameter of the pressing roller 31 increases from the center 31*c* to each lateral end 31*b* in the longitudinal direction thereof. As shown in FIG. 3, the projection 26*a* of the nip formation pad 26 is disposed downstream from the extension C extending in the direction perpendicular to the recording medium conveyance direction Y10 and passing through the rotation axis 31*a* of the pressing roller 31 in the recording medium conveyance direction Y10. As shown in FIGS. 3 and 5, the projection 26*a* projects toward the pressing roller 31 in a thickness direction of the recording medium P in a projection amount that increases from each lateral end 26*b* to the center 26*c* of the nip formation pad 26 in the longitudinal direction thereof. Accordingly, before the recording medium P is conveyed through the fixing nip NP, the protrusion 26*a* of the nip formation pad 26 directs tension exerted on the recording medium P from the center 26*c* to each lateral end 26*b* of the nip formation pad 26 in the longitudinal direction thereof, preventing the recording medium P from creasing. Conversely, as the recording medium P is conveyed through the fixing nip NP, the protrusion 26*a* of the nip formation pad 26 reduces tension exerted on the recording medium P and directed from each lateral end 26*b* to the center 26*c* of the nip formation pad 26 in the axial direction thereof, thus preventing the recording medium P from creasing as the recording medium P is conveyed through the fixing nip NP.

As shown in FIGS. 3 and 5, the projection 26*a* of the nip formation pad 26 projects toward the pressing roller 31 in the direction perpendicular to the recording medium conveyance direction Y10 in a projection amount that increases along the recording medium conveyance direction Y10. As shown in FIG. 5, the projection 26*a* of the nip formation pad 26 is curved along the recording medium conveyance direction Y10 such that an amount of projection of the nip formation pad 26 increases in the recording medium conveyance direction Y10. Additionally, the nip formation pad 26 is arc-shaped along the longitudinal direction of the nip formation pad 26 such that the center 26*c* of the projection 26*a* in the longitudinal direction of the nip formation pad 26 projects toward the pressing roller 31 farther than both lateral ends 26*b* of the projection 26*a* in the longitudinal direction of the nip formation pad 26.

Since the protrusion 26*a* of the nip formation pad 26 presses the fixing belt 21 and the recording medium P against the pressing roller 31 with increased pressure at the center 31*c* of the pressing roller 31 in the axial direction thereof, the difference between pressure exerted by the protrusion 26*a* of the nip formation pad 26 at the center 31*c* of the pressing roller 31 and pressure exerted by the protrusion 26*a* of the nip formation pad 26 at each lateral end 31*b* of the pressing roller 31 decreases at the position downstream from the center N of the fixing nip NP in the recording medium conveyance direction Y10. Accordingly, the protrusion 26*a* of the nip formation pad 26 reduces tension exerted on the recording medium P conveyed through the fixing nip NP and directed from each lateral end 31*b* to the center 31*c* of the pressing roller 31 in the axial direction thereof, preventing the recording medium P from creasing as the recording medium P is conveyed through the fixing nip NP.

As shown in FIG. 2, although the pressing roller 31 presses the fixing belt 21 against the nip formation pad 26 disposed opposite the inner circumferential surface of the fixing belt 21, the support 23 disposed opposite the inner circumferential surface of the fixing belt 21 contacts and supports the nip formation pad 26 against pressure from the pressing roller 31. Thus, even if the nip formation pad 26 receives pressure from the pressing roller 31, the support 23 supporting the nip formation pad 26 prevents the nip formation pad 26 from being bent by pressure from the pressing roller 31.

As shown in FIGS. 5 and 6, the support face 23*a* of the support 23 that contacts the nip formation pad 26 is arc-shaped such that an amount of projection of the support face 23*a* increases continuously from each lateral end 23*b* of the support face 23*a* that contacts each lateral end 26*b* of the nip formation pad 26 to the center 23*c* of the support face 23*a* that contacts the center 26*c* of the nip formation pad 26.

As the nip formation pad 26 and the pressing roller 31 are bent, the length of the fixing nip NP in the recording medium conveyance direction Y10 decreases continuously from each lateral end 26*b* of the nip formation pad 26 and each lateral end 31*b* of the pressing roller 31 in the longitudinal direction thereof to the center 26*c* of the nip formation pad 26 and the center 31*c* of the pressing roller 31 in the longitudinal direction thereof. Accordingly, the toner image T is fixed on the recording medium P with fixing quality that is even throughout the longitudinal direction of the pressing roller 31, thus preventing faulty fixing or variation in gloss of the toner image T fixed on the recording medium P.

The length of the nip formation pad 26 is greater than the length of the fixing nip NP in the recording medium conveyance direction Y10. As the outer circumferential surface of the pressing roller 31 is snagged or caught on the corner of the nip formation pad 26 at the position downstream from the center N of the fixing nip NP in the recording medium conveyance direction Y10, pressure exerted on the recording medium P by the pressing roller 31 may vary in the axial direction of the pressing roller 31, creasing the recording medium P. To address this circumstance, the nip formation pad 26 according to this example embodiment prevents the outer circumferential surface of the pressing roller 31 from being snagged or caught on the corner of the nip formation pad 26, thus preventing the recording medium P from creasing.

The fixing belt 21 is bent flexibly. Accordingly, as the pressing roller 31 presses the fixing belt 21 against the nip formation pad 26, the fixing belt 21 deforms flexibly to form the desired fixing nip NP between the fixing belt 21 and the pressing roller 31.

The length of the fixing nip NP in the recording medium conveyance direction Y10 decreases continuously from each lateral end 26*b* of the nip formation pad 26 and each lateral end 31*b* of the pressing roller 31 to the center 26*c* of the nip formation pad 26 and the center 31*c* of the pressing roller 31 in the longitudinal direction thereof. Accordingly, the toner image T is fixed on the recording medium P with fixing quality that is even throughout the longitudinal direction of the pressing roller 31, thus preventing faulty fixing or variation in gloss of the toner image T fixed on the recording medium P.

A description is provided of alternatives of the components incorporated in the fixing device 20 shown in FIG. 2.

According to the example embodiments described above, a halogen heater that radiates heat is used as the heater 25. Alternatively, an induction heater may be used as the heater 25, for example.

According to the example embodiments described above, the thermal conductor 22 is substantially circular in cross-section. Alternatively, the thermal conductor 22 may have other shapes that create a proper gap between the thermal conductor 22 and the fixing belt 21 to strike a balance between enhanced thermal conduction from the thermal conductor 22 to the fixing belt 21 and reduced frictional resistance between the thermal conductor 22 and the fixing belt 21 sliding thereover.

According to the example embodiments described above, the lubricant is applied between the thermal conductor 22 and the fixing belt 21. Alternatively, if the thermal conductor 22 is configured to facilitate sliding of the fixing belt 21 thereover, the lubricant may not be applied between the thermal conductor 22 and the fixing belt 21. Yet alternatively, in order to decrease frictional resistance between the thermal conductor 22 and the fixing belt 21 sliding thereover, an outer circumferential surface of the thermal conductor 22 that contacts the fixing belt 21 may be made of a material having a decreased friction coefficient. Further, a surface layer made of a fluorine material may constitute the inner circumferential surface of the fixing belt 21.

According to the example embodiments described above, the heater 25 heats the fixing belt 21 via the thermal conductor 22. Alternatively, if a separate component configured to conduct heat from the heater 25 to the fixing belt 21 evenly and facilitate stable rotation of the fixing belt 21 in the rotation direction R3 is available, the thermal conductor 22 may be eliminated and the heater 25 may heat the fixing belt 21 directly. In this case, since the total heat capacity of the fixing device 20 is reduced by the heat capacity of the eliminated thermal conductor 22, the fixing device 20 is heated more quickly, saving energy.

According to the example embodiments described above, no heater is situated inside the metal core 32 of the pressing roller 31 as shown in FIG. 2. Alternatively, a heater such as a halogen heater may be situated inside the pressing roller 31.

According to the example embodiments described above, the loop diameter of the fixing belt 21 is equivalent to the diameter of the pressing roller 31. Alternatively, the loop diameter of the fixing belt 21 may be smaller than the diameter of the pressing roller 31. In this case, the curvature of the fixing belt 21 at the fixing nip NP is greater than that of the pressing roller 31, facilitating separation of the recording medium P discharged from the fixing nip NP from the fixing belt 21. Yet alternatively, the loop diameter of the fixing belt 21 may be greater than the diameter of the pressing roller 31.

According to the example embodiments described above, regardless of a relation between the loop diameter of the fixing belt 21 and the diameter of the pressing roller 31, the thermal conductor 22 does not receive pressure from the pressing roller 31.

According to the example embodiments described above, the pressing roller 31 serves as a pressing rotary body. Alternatively, a pressing belt looped over a roller or the like may serve as a pressing rotary body.

According to the example embodiments described above, the pressing roller 31 is formed into an inverted crown shape by varying the thickness of the elastic layer 33 as shown in FIG. 4. Alternatively, the pressing roller 31 may be formed into an inverted crown shape by varying the outer diameter of the metal core 32.

According to the example embodiments described above, the fixing belt 21 serves as an endless belt. Alternatively, an endless film or the like may be used as an endless belt.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device comprising:

an endless belt rotatable in a given direction of rotation;

a heater disposed opposite and heating the endless belt;

a nip formation pad disposed opposite an inner circumferential surface of the endless belt; and a pressing rotary body pressed against the nip formation pad via the endless belt to form a fixing nip between the endless belt and the pressing rotary body, the fixing nip through which a recording medium is conveyed, the pressing rotary body having a diameter increasing from a center to each lateral end in an axial direction thereof, the nip formation pad including a projection disposed downstream from a rotation axis of the pressing rotary body in a recording medium conveyance direction, the projection projecting at most one side toward the pressing rotary body in an amount increasing from each lateral end to a center in a longitudinal direction of the nip formation pad parallel to the axial direction of the pressing rotary body.

2. The fixing device according to claim 1, wherein the projection of the nip formation pad projects toward the pressing rotary body in an amount increasing along the recording medium conveyance direction.

3. The fixing device according to claim 1, wherein the projection of the nip formation pad is curved along the recording medium conveyance direction and arc-shaped along the longitudinal direction of the nip formation pad.

4. The fixing device according to claim 1, further comprising a support disposed opposite the inner circumferential surface of the endless belt to contact and support the nip formation pad against pressure from the pressing rotary body.

5. The fixing device according to claim 4, wherein the support includes a support face contacting the nip formation pad and projecting toward the nip formation pad in an amount increasing from each lateral end to a center in a longitudinal direction of the support parallel to the longitudinal direction of the nip formation pad.

6. The fixing device according to claim 5, wherein the support face of the support is arc-shaped along the longitudinal direction of the support.

7. The fixing device according to claim 5, wherein each lateral end of the support face of the support in the longitudinal direction thereof is disposed opposite each lateral end of the pressing rotary body in the axial direction thereof and the center of the support face of the support in the longitudinal direction thereof is disposed opposite the center of the pressing rotary body in the axial direction thereof.

8. The fixing device according to claim 1, wherein a length of the nip formation pad is greater than a length of the fixing nip in the recording medium conveyance direction.

9. The fixing device according to claim 1, wherein the endless belt is bendable flexibly.

10. The fixing device according to claim 1, wherein the fixing nip has a length in the recording medium conveyance direction that decreases from each lateral end to a center of the fixing nip in the axial direction of the pressing rotary body.

11. The fixing device according to claim 1, wherein the heater is disposed opposite the inner circumferential surface of the endless belt.

12. The fixing device according to claim 1, wherein the pressing rotary body includes a pressing roller.

13. An image forming apparatus comprising the fixing device according to claim 1.

* * * * *